US005864083A

United States Patent [19]

Caren

[11] Patent Number: 5,864,083

[45] Date of Patent: Jan. 26, 1999

[54] MUSICAL EFFECT CONTROLLER AND SYSTEM FOR AN ELECTRIC GUITAR

[76] Inventor: Michael P. Caren, 756 Clara Dr., Palo Alto, Calif. 94303

[21] Appl. No.: 993,877

[22] Filed: Dec. 18, 1997

[51] Int. Cl.[6] ..... G10H 1/02

[52] U.S. Cl. ..... 84/737; 84/322

[58] Field of Search ..... 84/320, 322, 737, 84/743

[56] References Cited

U.S. PATENT DOCUMENTS

| | | | |
|---|---|---|---|
| 3,503,031 | 3/1970 | K.A. Nyhus et al. | 338/99 |
| 3,530,227 | 9/1970 | R.L. Wheeler et al. | 84/1.16 |
| 4,064,781 | 12/1977 | Fals | 84/388 |
| 4,171,659 | 10/1979 | Tumminaro | 84/1.16 |
| 4,235,144 | 11/1980 | Lubow et al. | 84/1.16 |
| 4,292,875 | 10/1981 | Nourney | 84/1.14 |
| 4,314,227 | 2/1982 | Eventoff | 338/99 |
| 4,365,537 | 12/1982 | Pogoda | 84/454 |
| 4,503,746 | 3/1985 | Kakehashi | 84/1.16 |
| 4,649,784 | 3/1987 | Fulks et al. | 84/1.1 |
| 4,810,992 | 3/1989 | Eventoff | 338/99 |
| 5,008,497 | 4/1991 | Asher | 178/18 |
| 5,079,536 | 1/1992 | Chapman | 338/99 |
| 5,099,742 | 3/1992 | Meno | 84/690 |
| 5,105,711 | 4/1992 | Barnard | 84/737 X |
| 5,245,128 | 9/1993 | Araiza | 84/626 |
| 5,289,827 | 3/1994 | Orkin et al. | 128/775 |
| 5,300,730 | 4/1994 | Ekhaus | 84/734 |
| 5,398,962 | 3/1995 | Kropp | 280/731 |
| 5,459,283 | 10/1995 | Birdwell Jr. | 84/737 |
| 5,478,969 | 12/1995 | Cardey, III et al. | 84/626 |
| 5,563,354 | 10/1996 | Kropp | 73/862.473 |

*Primary Examiner*—William M. Shoop, Jr.
*Assistant Examiner*—Jeffrey W. Donels
*Attorney, Agent, or Firm*—Limbach & Limbach L.L.P.

[57] ABSTRACT

A musical device controller and system that includes an electric guitar having strings and a pick-up that produces an electrical music signal from vibrations of the strings, a musical effect generator that receives the electrical music signal from the guitar and alters the musical signal to produce a musical effect, a guitar pick for striking the strings to cause the vibrations, and a force sensing device mounted on the guitar pick. The force sensing device has a pair of electrical leads connected to the musical effect generator, and a pressure sensitive material that is formed of a semi-conductor material having microprotrusions or a pressure sensitive ink. The electrical leads are in contact with the pressure sensitive material such that electrical resistance between the pair of leads incrementally and repeatably decreases as a force applied to the force sensing device incrementally increases. The musical effect generator is responsive to, and varies the musical effect according to, the resistance between the pair of leads.

24 Claims, 7 Drawing Sheets

MUSICAL EFFECT CONTROLLER AND SYSTEM FOR AN ELECTRIC GUITAR

FIELD OF THE INVENTION

The present invention relates to electric guitars, and more particularly to control devices used to control electronic musical effect generators.

BACKGROUND OF THE INVENTION

Electric guitars and other modern stringed instruments produce signals that are passed through a chain of electronic musical effect generators before being amplified and passed to a speaker or headphone system. These electronic effect generators alter the final output sound by modifying properties such as the frequency response, overall amplitude, envelope characteristics, echo, reverberation and distortion.

Prior art devices provide control over these properties with knobs, hand or foot switches, foot pedals and in some cases by preset signal levels. It can be appreciated, however, that these devices for changing characteristics of the sound signal have several disadvantages or limitations.

First, in the case of simple hand and foot switches, the musician can only turn the effect on or off. There is no way control the amount of the effect. To solve this, many of these devices incorporate dials and knobs so the guitarist can adjust the amount of a given effect. However, a musician using these dials and knobs must remove his or her hands from the strings of the guitar to adjust the amount of the effect. This causes an unacceptable disruption in the playing of the instrument and thereby limits the usefulness of these devices and the achievement of the desired sound effect.

Dynamic foot peddle effect generators have been developed, such as those illustrated in U.S. Pat. No. 3,530,224, which are operated by foot and change the parameters of the effect dynamically as the pedal is actuated back and forth. These types of foot peddles are quite effective in not interrupting the playing of the instrument, but are limited by the lack of sensitivity and speed of actuation. Moreover, they limit the musician to a single fixed position on the stage.

U.S. Pat. No. 4,503,746 addresses the musician mobility issue by using the force the musician applies to the shoulder strap as a means for controlling musical effect parameters. Although successful in decoupling the musician from a certain point on a stage, this configuration lacks the sensitivity and speed of actuation needed for most musicians.

Another prior art device is taught in U.S. Pat. No. 4,235,144, which includes a contact switch in the guitar pick to determine the exact time the pick strikes the string. This signal is then used to initiate a predetermined effect as well as increment a strike counter that controls an overall variation of a special musical effect. There are, however, several drawbacks to this technique. First, the musician cannot successfully control the effect without striking a string or some other object. Second, the variation in the effect will be coupled only when the string is struck. Third, there is no analog control of the effect parameters.

U.S. Pat. No. 5,300,730 teaches a device that uses strain gauges in the neck and on the guitar pick to control the sound effects. By bending the guitar neck and pick, the musician generates control signals that are used by special effect circuits to modify the electric guitar signal. Unfortunately, the embodiments taught in this patent have several drawbacks. First, one embodiment employs a piezo-electric (PZT) film as a strain gauge. This is problematic because a PZT film is a poor transducer for low frequency or constant signals due to its internal resistance. Further, the PZT film senses the strain of the pick, and the signal generated by forces on the pick is very small. In addition, PZT films are not repeatable with constant forces over time. Finally, PZT films need special signal conditioning circuitry. Another embodiment of this patent suggests using a metal foil strain gauge. However, metal foil strain gauges also produce a relatively low signal level, thus resulting in an unacceptable signal-to-noise ratio. Metal foil strain gauges are also subject to temperature drift and require special signal conditioning circuitry. Moreover, both PZT and metal foil embodiments require extra cabling, and/or wiring, which is very cumbersome for the musician who is recording or practicing, and is unacceptable for a musician performing on a stage.

Thus, there is a need for a simple, low noise, sensitive musical effect controller that a musician can dynamically control without disrupting his or her playing. There is a further need for the effect controller to utilize a sensor that has an adequate frequency response, relatively high signal level, low noise, small temperature drift, requires minimal or no signal conditioning circuitry and no extra cabling, and is easily manufacturable.

SUMMARY OF THE INVENTION

The present invention solves the aforementioned problems by providing a hand held musical effect controller and system that provides an accurate and repeatable signal corresponding to the force applied to the controller for dynamic control of musical effect generators. The controller has a superior frequency response, minimal temperature drift, and is easy to manufacture.

The musical effect controller of the present invention operates a musical effect generator that alters the electrical music output signal from an electric guitar in response to a controller signal received by a musical effect generator input port. The musical effect controller includes a substantially rigid member and a force sensing device mounted thereon. The force sensing device has a pair of electrical leads connectable to a musical effect generator input port. The force sensing device further includes a pressure sensitive material that is formed of a semiconductor material having microprotrusions or a pressure sensitive ink. The electrical leads are in contact with the pressure sensitive material such that electrical resistance between the pair of leads incrementally and repeatably decreases as a force applied to the force sensing device incrementally increases.

In another aspect of the present invention, a musical effect system includes an electric guitar having strings and a pick-up that produces an electrical music signal from vibrations of the strings, a musical effect generator that receives the electrical music signal from the guitar and alters the musical signal to produce a musical effect, a guitar pick for striking the strings to cause the vibrations, and a force sensing device mounted on the guitar pick. The force sensing device has a pair of electrical leads connectable to the musical effect generator, and a pressure sensitive material that is formed of a semiconductor material having microprotrusions or a pressure sensitive ink. The electrical leads are in contact with the pressure sensitive material such that electrical resistance between the pair of leads incrementally and repeatably decreases as a force applied to the force sensing device incrementally increases. The musical effect generator is responsive to, and varies the musical effect according to, the resistance between the pair of leads.

Other objects and features will become apparent by a review of the specification, claims and appended figures.

DETAILED DESCRIPTION OF THE PREFERRED EMBODIMENTS

The present invention is a musical effect controller and system for electric guitars that allows a musician to dynamically control a musical effect generator without disrupting the musician's play or stage performance.

Figure 1:
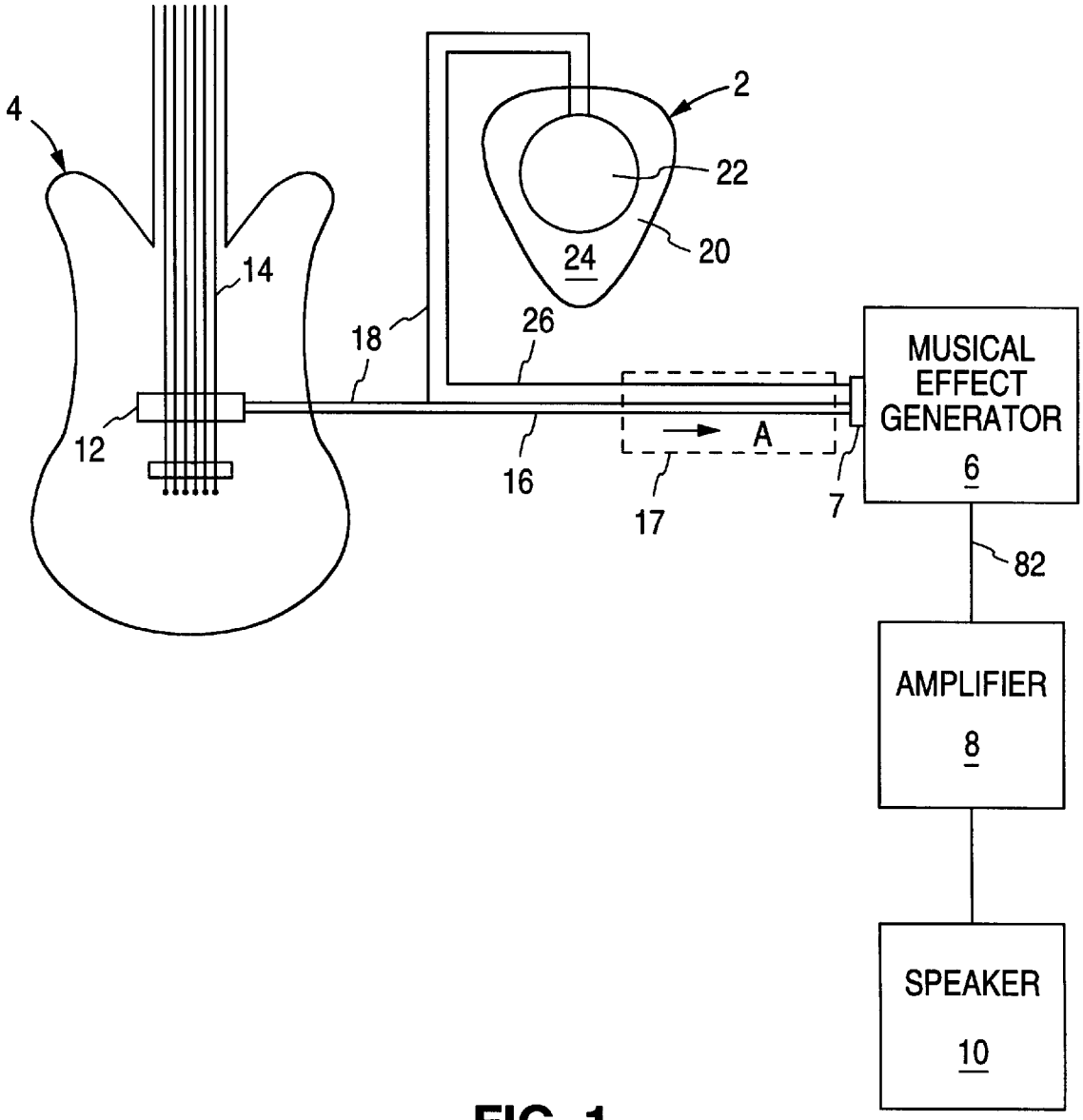
FIG. 1 is a schematic view of the guitar musical effect controller of the present invention.

FIG. 1 illustrates the musical effect controller and system of the present invention, which includes a special guitar pick 2 used in conjunction with an electric guitar 4, a musical effect generator 6, an amplifier 8 and a speaker 10.

The electric guitar 4 includes an electric guitar pickup 12 located below guitar strings 14. Vibrations in the guitar strings 14 provide a signal voltage A, which is carried by cable 16 (and common ground cable 18) from the guitar 4 to the musical effect generator 6.

The musical effect generator 6 modifies signal A according to a signal received by input port 7, and then passes modified signal A to the amplifier 8 and speaker 10.

Pick 2 includes a substantially rigid guitar pick member 20 (preferably made of plastic or wood) and a force sensing device 22 attached to one of the faces 24 of pick member 20. The force sensing device 22 is preferably attached to pick face 24 by a pressure sensitive adhesive or tape, or by silk screening. The force sensing device 22 accurately senses external forces applied thereto, which is measured by the musical effect generator 6 via cable 26 (and common ground cable 18).

Figure 2A:
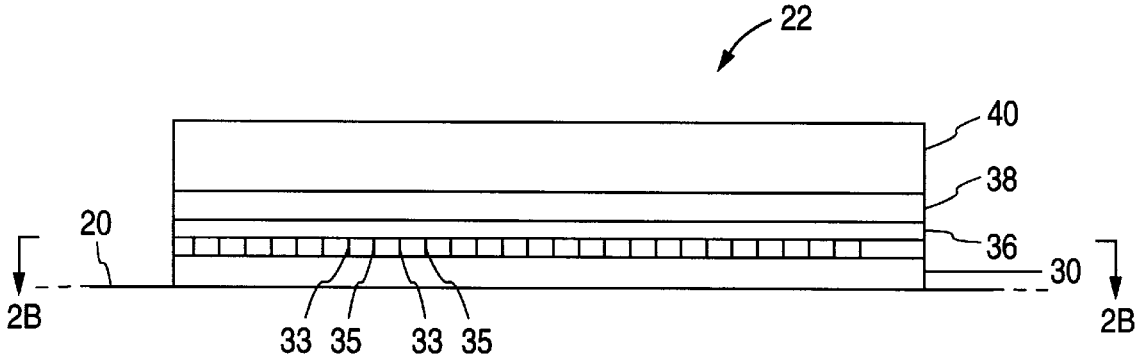
FIG. 2A is a side cross-sectional view of the force sensing device of the present invention.
Figure 2B:
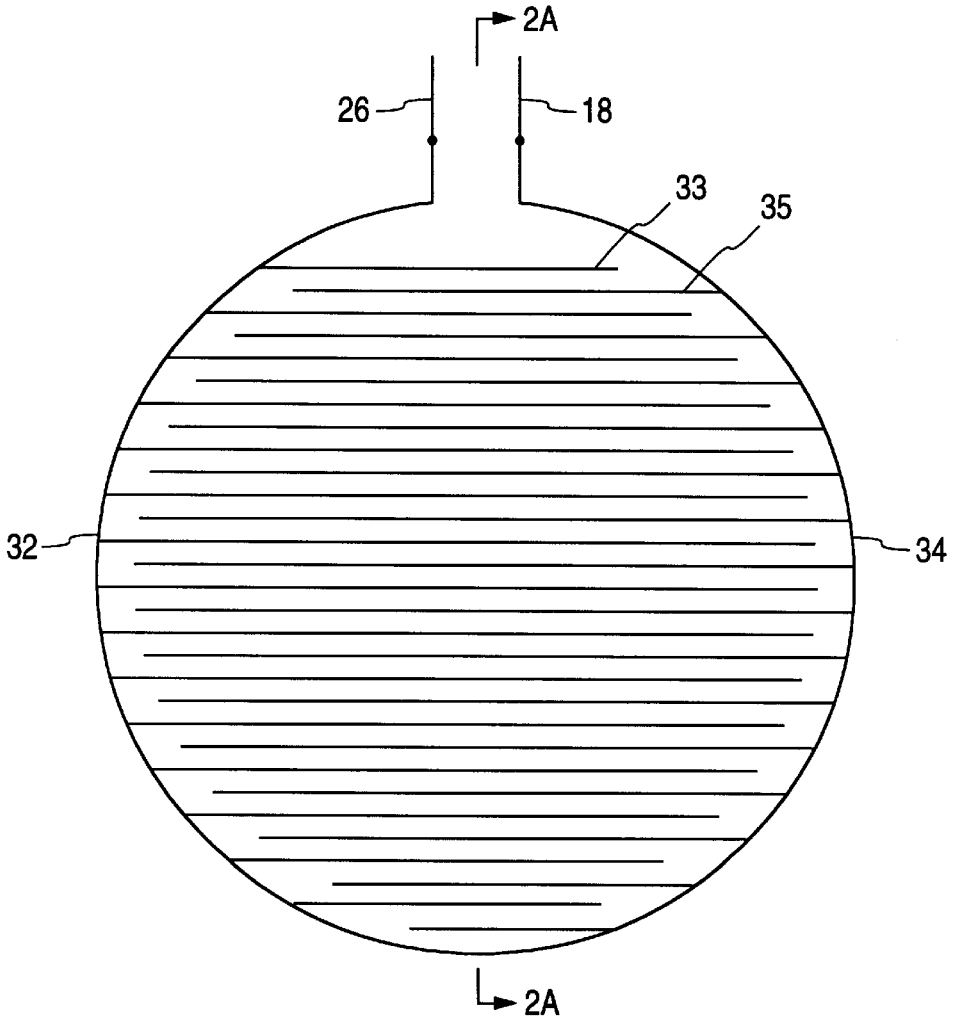
FIG. 2B is a top cross-sectional view of the force sensing device of the present invention.

The force sensing device 22 is illustrated in FIGS. 2*a* and 2*b,* and includes one or more bottom support members 30 that attach to pick member 20, contact leads 32 and 34 (with interleaved arm portions 33 and 35 respectively) on support member 30, a layer of pressure sensitive material 36 overlaying the contact leads 32/34, at least one top flexible support member 38 overlaying the pressure sensitive material 36, and a layer of soft compressible material 40 overlaying the top support member 38. Contact leads 32 and 34 are attached to cables 26 and 18 respectively. In a static state, the pressure sensitive material 36 offers a high resistance between contact leads 32 and 34. As pressure on the force sensing device 22 increases (i.e. an external force applied by the musician), the electrical resistance of force sensing device 22 decreases because the pressure sensitive material 36 increases its conduction of electricity between leads 32 and 34 in a repeatable, and preferably linear, fashion. The layer of compressible material 40 protects the contact leads 32/34 and pressure sensitive material 36, as well as provides the musician with tactile feedback. It should be noted that the contact leads 32/34 can overlay layer 36, instead of layer 36 overlaying contact leads 32/34 as illustrated in FIGS. 2*a*/*b*.

Figure 3:
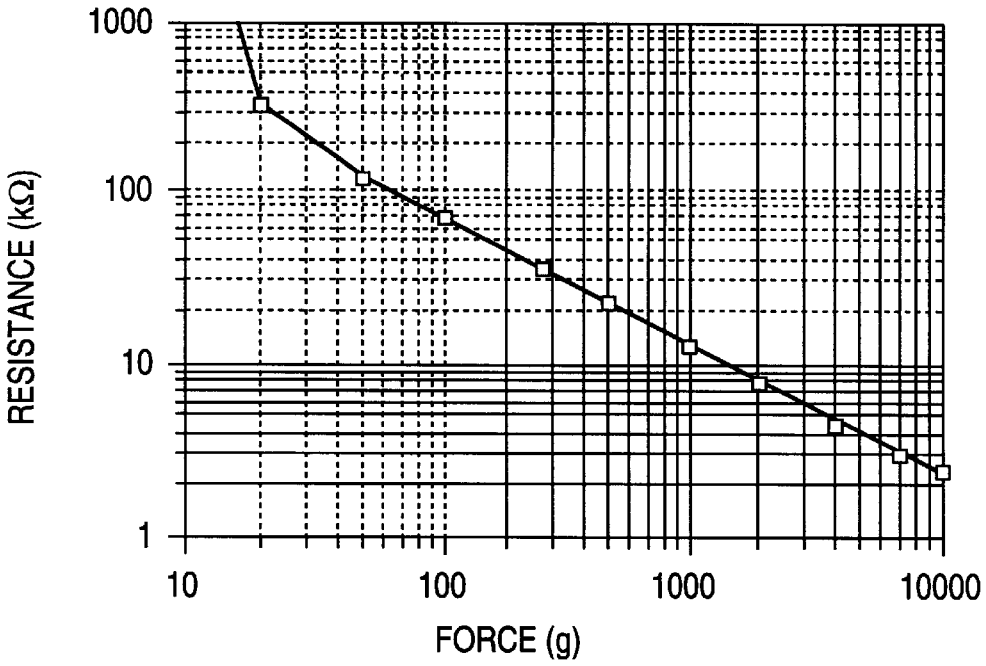
FIG. 3 is a graph illustrating the decrease in electrical resistance of the force sensing device with increased force thereon.

The pressure sensitive material 36 must provide a repeatable, and preferably linear, resistance versus pressure relationship between leads 32 and 34. Several types of pressure sensitive materials work well for layer 36 of force sensing device 22. One type of material is a semiconductor material having a smooth surface facing contact leads 32/34, wherein the smooth surface provides a multiplicity of microprotrusions for contacting the contact leads 32/34. An example of this material is an acrylic resin with molybdenum disulfide particulate having particle sizes on the order of one to ten microns. Such a material is disclosed in U.S. Pat. No. 4,314,227, which is incorporated herein by reference. As pressure on layer 36 increases, the number of microprotrusions making contact with the contact leads 32/34 also increases, thus increasing the conductivity between contact leads 32/34 via layer 36. This type of force sensing device is available from Interlink Electronics, Camarillo, Calif. FIG. 3 illustrates the change in resistance with the change in applied force for this type of force sensing device.

Another type of pressure sensitive material ideal for layer 36 of force sensing device 22 is a pressure sensitive ink or paint as described in U.S. Pat. No. 3,503,031, which is incorporated herein by reference. Such an ink or paint has a resistivity which varies inversely with the application of pressure thereto. Examples of pressure sensitive inks/paints include carbon-impregnated rubber materials, fibers impregnated with conducting particles, foamed materials impregnated with conductive materials or finely divided or granulated carbon. The resistance range of the ink/paint layer is further determined by the contact area and layer thickness, as well as the amount of conductive material used to form the ink/paint. This type of force sensing device is available from Force Imaging Technologies, Chicago, Ill.

In operation, the resistance of force sensing device 22 is determined by the force applied on pick 2 by the musician. The musical effect generator 6 measures the electrical resistance of force sensing device 22 via cables 26 and 18, and changes the desired musical effect on music signal A accordingly. The musician changes the force applied to pick 2 to change the musical effect induced by musical effect generator 6 on the music outputed by speaker 10.

Figure 4A:
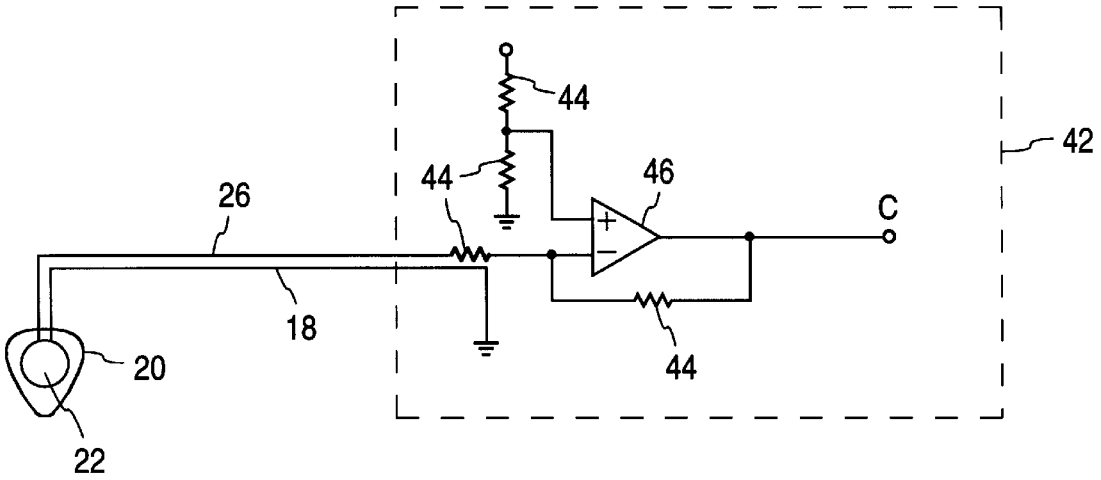
FIG. 4A is a schematic diagram of a control voltage circuit.
Figure 4B:
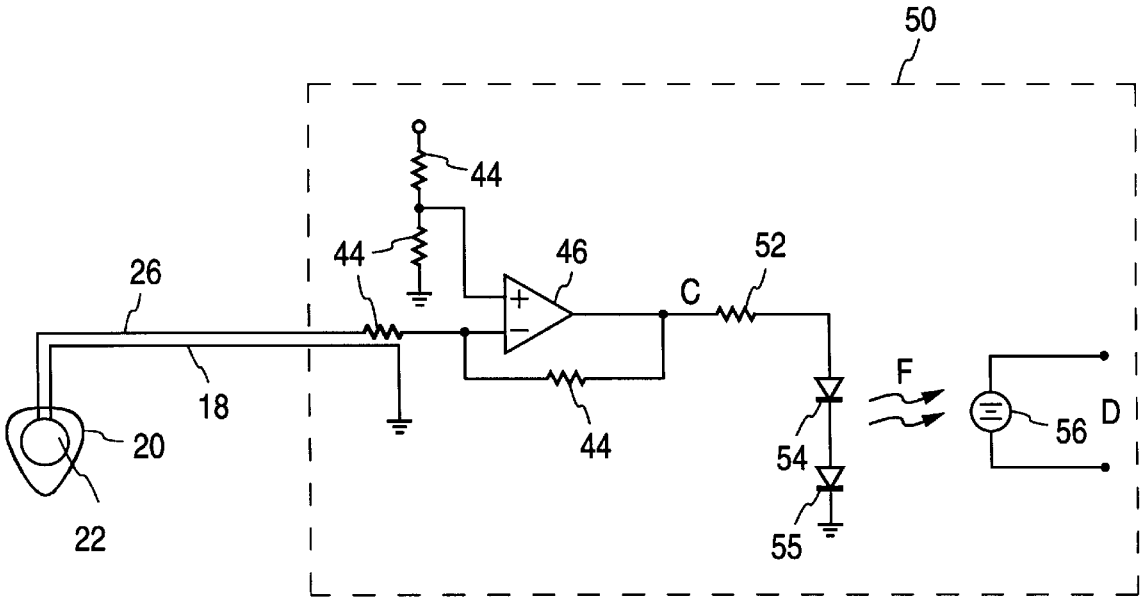
FIG. 4B is a schematic diagram of a control resistance circuit.

FIGS. 4A and 4B illustrate signal conditioning circuits that can be used to measure the resistance of force sensing device 22, or to interface the force sensing device 22 with the electrical circuitry of musical generator 6. These circuits have two important design objectives for the force sensing device 22: 1) to share a common ground with the guitar signal voltage, and 2) to limit the current through the force sensing device 22 to 1mA per square centimeter of sensor area. FIG. 4A shows a representative embodiment of a control voltage circuit 42, which includes resistors 44 and a non-inverting amplifier 46. Circuit 42 uses the change in resistance from the force sensing device 22 to adjust the gain of the non-inverting amplifier 46. The change in gain of the amplifier 44 generates a change in the output voltage C of the control voltage circuit 42, which is related to the force the musician exerts on the pick 2. This output voltage C can then be used to control the parameters of musical effect generator 6.

FIG. 4B illustrates a control resistance circuit 50 which is similar to control voltage circuit 42 of FIG. 4, but further includes resistor 52, LED 54, diode 55 and photocell 56. Control resistance circuit 50 produces an output D that has a change in resistance related to the pressure applied to the force sensing device 22 by the musician. Voltage C is connected to a resistor 52 and LED 54, which produces a light intensity F. The LED 54 is situated in close proximity to the photocell 56. Changes in light intensity F will initiate a change in resistance in the photocell 56 which can be used to control the parameters of musical effect generator 6. Control resistance circuit 50 is ideal for retrofitting existing control circuitry that use a potentiometer to control the musical effect parameters.

The control circuits 42/50 of FIGS. 4A and 4B are illustrative of the types of control circuits that can be used with the present invention. Circuits 42 or 50 can be part of musical effect generator 6, or placed between pick/guitar 2/4 and musical effect generator 6 along cables 16/18/26. However, one advantage of the present invention is that no control circuits may be necessary to operate the musical effect generator 6 and obtain the desired results. The force sensing device 22 can be placed directly in any existing circuitry in place of a potentiometer that is used to control the musical effect parameters.

Figure 5:
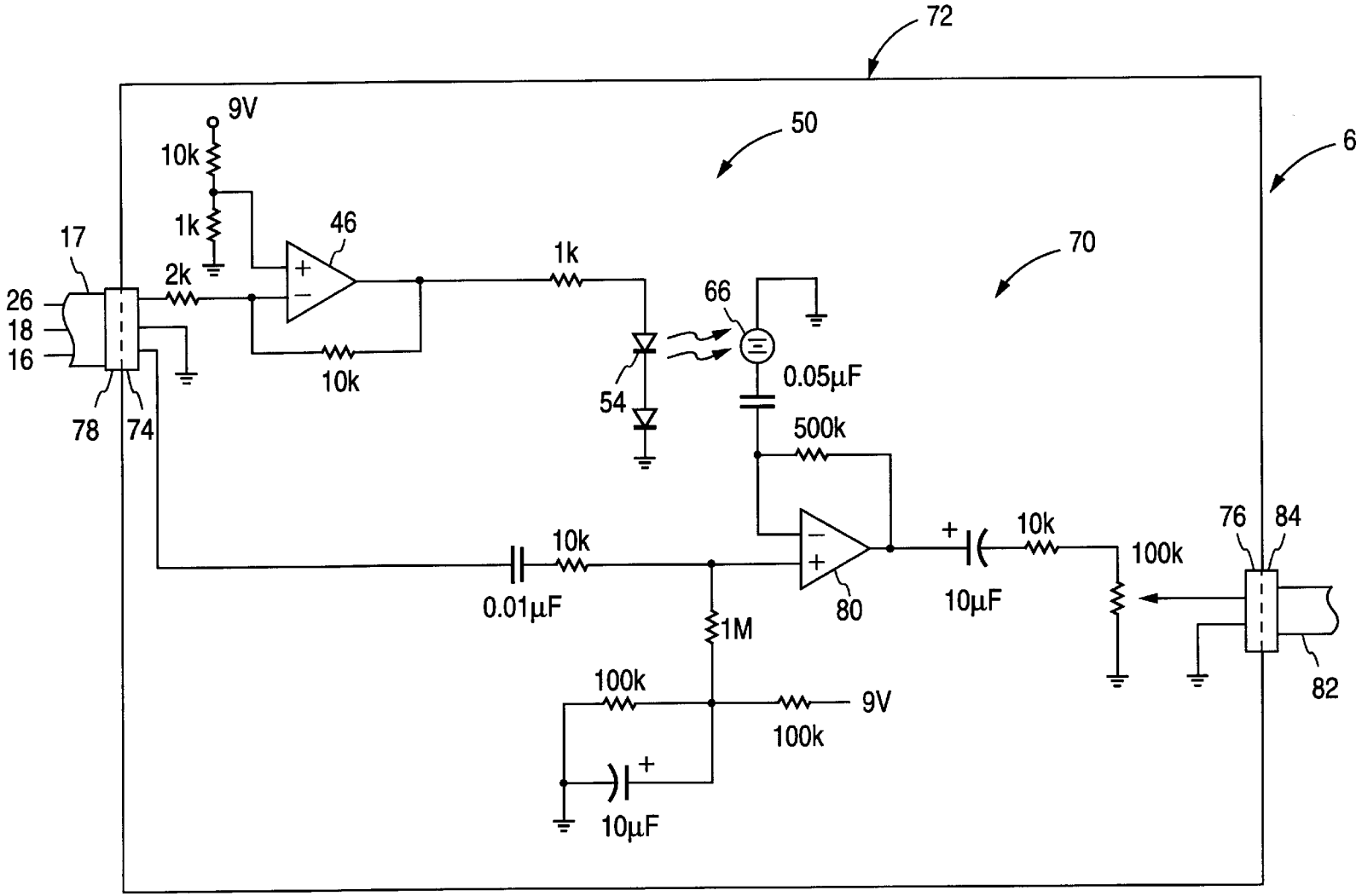
FIG. 5 is a schematic diagram of a self contained musical effect generator utilizing the control resistance circuit.

FIG. 5 illustrates a self contained musical effect generator 6 that incorporates the control resistance circuit 50 of FIG. 4B, and is fitted with an active volume control circuit 70 for controlling the volume of the guitar signal sent to the amplifier 8 and speaker 10 based upon the pressure applied to the force sensing device 22. The self contained musical effect generator includes a housing 72, a standard input stereo jack 74, the control circuit 70, and a standard output mono jack 76. Cables 16/18/26 are combined into a single stereo cable 17 (having two signal wires 16/26 and a common ground wire 18 used by both the guitar pickup 12 and force sensing device 22). Cable 17 terminates in a single standard stereo plug 78 that plugs into the input stereo jack 74. When plug 78 is plugged into jack 74, cable 26 is connected to the first op-amp 46, which is utilized as a non-inverting amplifier that increases the current flow through the LED 54 as increased pressure is applied to the force sensing device 22. Cable 16 is connected to a second op-amp 80, which is utilized as a non-inverting amplifier that amplifies the guitar signal. The amplification gain increases as the photocell 56 resistance decreases due to increased light emissions from the LED 54. The output of the control circuit 70 is connected to the mono jack 76. A mono cable 82 (having a single signal wire and a ground wire) has one end plugged into the output jack 76 via a standard mono plug 84, and the other end connected to the amplifier 8. Therefore, the musician can control the volume level of the modified guitar signal by changing the pressure applied on the force sensing device 22. Examples of other control circuits that can be used instead of volume control circuit 70 include control circuits that modify properties such as the frequency response, envelope characteristics, echo, reverberation and distortion.

Figure 6:
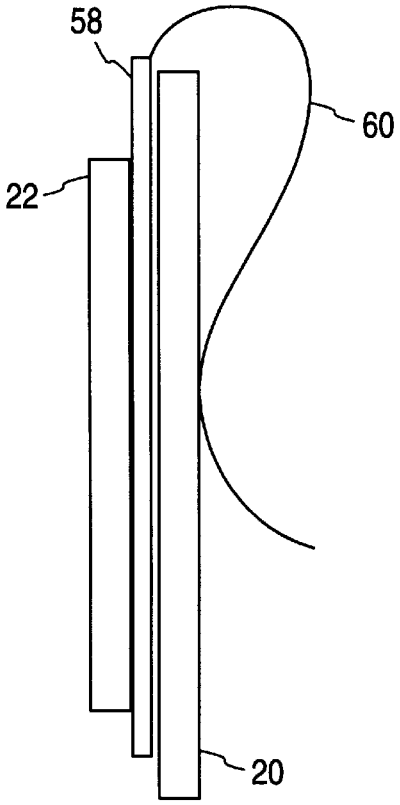
FIG. 6 is a side view of a clip used to removably fasten the force sensing device of the present invention to a guitar pick.

FIG. 6 illustrates an alternate embodiment of the present invention, where the force sensing device 22 is mounted on a clip 58, which removably snaps onto pick member 20 using an opposing elastic clip member 60. This allows the musician to change pick sizes or replace broken pick members 20 without having to purchase a new force sensing device 22. Alternately, an adhesive or tape can be used to semi-permanently attach the force sensing device 22 to pick member 20 so that these two elements can be separated when pick member 20 needs replacing.

Figure 7A:
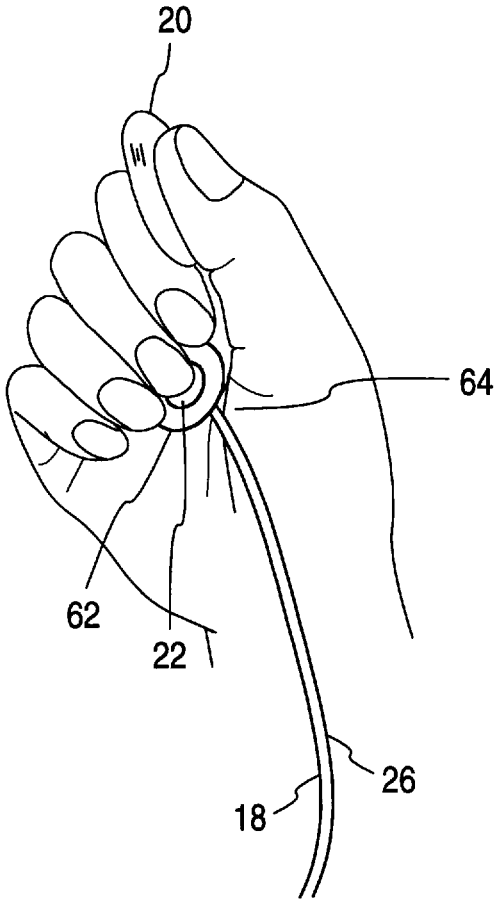
FIG. 7A is a top view of a hand-held embodiment of the force sensing device of the present invention positioned in the palm of a musician's hand.
Figure 7B:
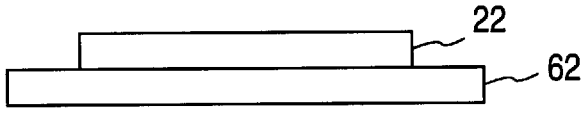
FIG. 7B is a side view of the hand-held embodiment of the force sensing device of the present invention.

FIGS. 7A and 7B illustrate another embodiment of the present invention, where the force sensing device 20 is mounted on a substantially rigid member 62, so that the force sensing device 20 can be placed in the palm of the musician's hand 64 for use independent of the pick member 20. This allows the musician to fully decouple the picking of the strings from the actuation of the force sensing device 22.

Figure 8:
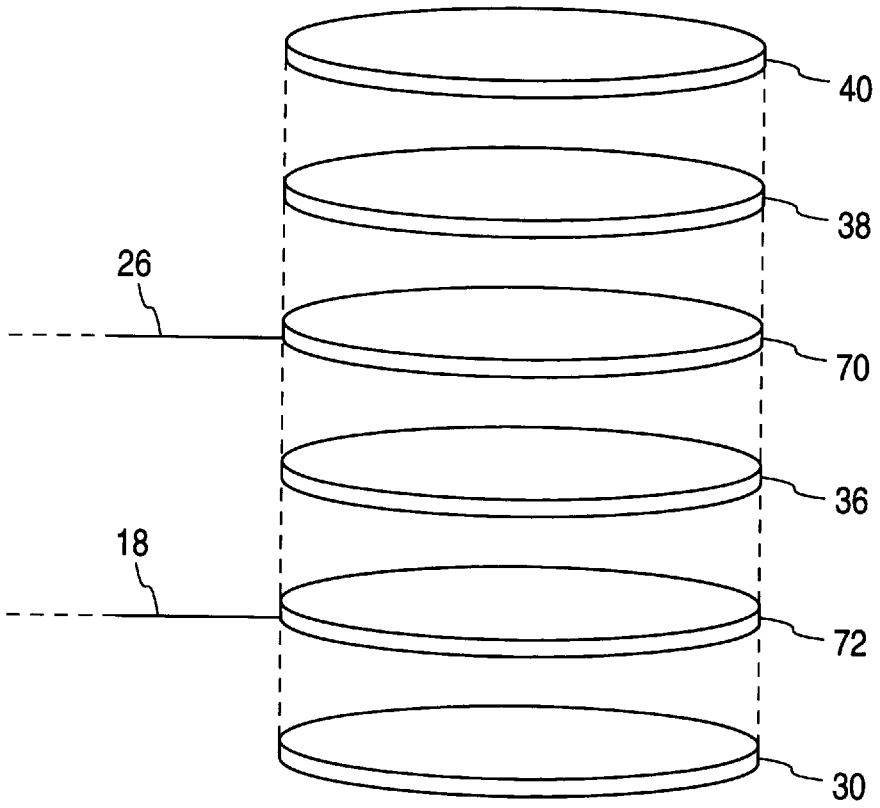
FIG. 8 is an exploded perspective view of an alternate embodiment of the force sensing device of the present invention.

It is to be understood that the present invention is not limited to the embodiments described above and illustrated herein, but encompasses any and all variations falling within the scope of the appended claims. For example, it is within the scope of the present invention not to interleave contact leads 32/34, but instead form these contact leads out of flat layer materials, where flat contact leads in the form of layers 70/72 are disposed with the pressure sensitive material 36 sandwiched therebetween, as illustrated in FIG. 8. Further, musical effect generator 6, amplifier 8 and speaker 10 can be combined as a single unit device. In addition, the present musical effect controller can be used to operated other electrical stringed instruments. Finally, output jack 76 need not be a mono jack, but rather could be a stereo jack with mono or stereo output signal(s).

What is claimed is:

1. A musical effect controller for operating a musical effect generator that alters the electrical music output signal from an electric stringed instrument in response to a controller signal received by a musical effect generator input port, comprising:

a substantially rigid member; and a force sensing device mounted on the substantially rigid member and having a pair of electrical leads connectable to a musical effect generator input port, the force sensing device includes a pressure sensitive material that is formed of one of a semiconductor material having microprotrusions and a pressure sensitive ink, wherein the electrical leads are in contact with the pressure sensitive material such that electrical resistance between the pair of leads incrementally and repeatably decreases as a force applied to the force sensing device incrementally increases; and a compressible layer of material overlaying the force sensing device to give tactile feedback to the musician.

2. The musical effect controller of claim 1, wherein the rigid member is a guitar pick.

3. The musical effect controller of claim 2, wherein one of the pair of leads have arm portions that interleave arm portions of the other of the pair of leads.

4. The musical effect controller of claim 3, wherein the leads are connected to a control circuit that outputs a control signal voltage that varies with the resistance of the force sensing device.

5. The musical effect controller of claim 2, wherein one of the pair of leads terminates in a first layer, the other one of the pair of leads terminates in a second layer, and the pressure sensitive material is formed as a third layer disposed between the first and second layer.

6. The musical effect controller of claim 2, the electrical resistance between the pair of leads changes substantially linearly with changes in force applied to the force sensing device.

7. A musical effect controller for operating a musical effect generator that alters the electrical music output signal from an electric stringed instrument in response to a controller signal received by a musical effect generator input port, comprising:

a substantially rigid member, wherein the rigid member is a guitar pick;

a force sensing device mounted on the substantially rigid member and having a pair of electrical leads connectable to a musical effect generator input port, the force sensing device includes a pressure sensitive material that is formed of one of a semiconductor material having microprotrusions and a pressure sensitive ink, wherein the electrical leads are in contact with the pressure sensitive material such that electrical resistance between the pair of leads incrementally and repeatably decreases as a force applied to the force sensing device incrementally increases; and a removable clip member having an opposing elastic member, wherein the force sensing device is attached to the clip member, and the clip member removably attaches to the guitar pick by disposing the guitar pick between the clip member and the elastic member.

8. A musical effect controller for operating a musical effect generator that alters the electrical music output signal from an electric stringed instrument in response to a controller signal received by a musical effect generator input port, comprising:

a substantially rigid member, wherein the rigid member is a guitar pick; and a force sensing device mounted on the substantially rigid member and having a pair of electrical leads connectable to a musical effect generator input port, the force sensing device includes a pressure sensitive material that is formed of one of a semiconductor material having microprotrusions and a pressure sensitive ink, wherein the electrical leads are in contact with the pressure sensitive material such that electrical resistance between the pair of leads incrementally and repeatably decreases as a force applied to the force sensing device incrementally increases;

wherein the force sensing device is attached to the guitar pick by one of an adhesive and silkscreening.

9. A musical effect controller for operating a musical effect generator that alters the electrical music output signal from an electric stringed instrument in response to a controller signal received by a musical effect generator input port, comprising:

a substantially rigid member, wherein the rigid member is a guitar pick; and a force sensing device mounted on the substantially rigid member and having a pair of electrical leads connectable to a musical effect generator input port, the force sensing device includes a pressure sensitive material that is formed of one of a semiconductor material having microprotrusions and a pressure sensitive ink, wherein the electrical leads are in contact with the pressure sensitive material such that electrical resistance between the pair of leads incrementally and repeatably decreases as a force applied to the force sensing device incrementally increases;

wherein one of the pair of leads have arm portions that interleave arm portions of the other of the pair of leads, and wherein the leads are connected to a control circuit that outputs a control signal resistance that varies with the resistance of the force sensing device.

10. A musical effect controller for operating a musical effect generator that alters the electrical music output signal from an electric stringed instrument in response to a controller signal received by a musical effect generator input port, comprising;

a substantially rigid member, wherein the rigid member is a guitar pick;

a force sensing device mounted on the substantially rigid member and having a pair of electrical leads connectable to a musical effect generator input port, the force sensing device includes a pressure sensitive material that is formed of one of a semiconductor material having microprotrusions and a pressure sensitive ink, wherein the electrical leads are in contact with the pressure sensitive material such that electrical resistance between the pair of leads incrementally and repeatably decreases as a force applied to the force sensing device incrementally increases; and a compressible layer of material overlaying the force sensing device to give tactile feedback to the musician.

11. A musical effect system comprising:

an electric guitar having strings and a pick-up that produces an electrical music signal from vibrations of the strings;

a musical effect generator that receives the electrical music signal from the guitar and alters the musical signal to produce a musical effect;

a guitar pick for striking the strings to cause the vibrations;

a force sensing device mounted on the guitar pick and having a pair of electrical leads connectable to the musical effect generator, the force sensing device includes a pressure sensitive material that is formed of one of a semiconductor material having microprotrusions and a pressure sensitive ink, wherein the electrical leads are in contact with the pressure sensitive material such that electrical resistance between the pair of leads incrementally and repeatably decreases as a force applied to the force sensing device incrementally increases; and a removable clip member having an opposing elastic member, wherein the force sensing device is attached to the clip member, and the clip member removably attaches to the guitar pick by disposing the guitar pick between the clip member and the elastic member;

wherein the musical effect generator is responsive to, and varies the musical effect according to, the resistance between the pair of leads.

12. A musical effect system, comprising:

an electric guitar having strings and a pick-up that produces an electrical music signal from vibrations of the strings;

a musical effect generator that receives the electrical music signal from the guitar and alters the musical signal to produce a musical effect;

a guitar pick for striking the strings to cause the vibrations; and a force sensing device mounted on the guitar pick and having a pair of electrical leads connectable to the musical effect generator, the force sensing device includes a pressure sensitive material that is formed of one of a semiconductor material having microprotrusions and a pressure sensitive ink, wherein the electrical leads are in contact with the pressure sensitive material such that electrical resistance between the pair of leads incrementally and repeatably decreases as a force applied to the force sensing device incrementally increases;

wherein the musical effect generator is responsive to, and varies the musical effect according to, the resistance between the pair of leads, and wherein the force sensing device is attached to the guitar pick by one of an adhesive and silkscreening.

13. A musical effect system, comprising:

an electric guitar having strings and a pick-up that produces an electrical music signal from vibrations of the strings;

a musical effect generator that receives the electrical music signal from the guitar and alters the musical signal to produce a musical effect;

a guitar pick for striking the strings to cause the vibrations; and a force sensing device mounted on the guitar pick and having a pair of electrical leads connectable to the musical effect generator, the force sensing device includes a pressure sensitive material that is formed of one of a semiconductor material having microprotrusions and a pressure sensitive ink, wherein the electrical leads are in contact with the pressure sensitive material such that electrical resistance between the pair of leads incrementally and repeatably decreases as a force applied to the force sensing device incrementally increases;

wherein the musical effect generator is responsive to, and varies the musical effect according to, the resistance between the pair of leads, and wherein one of the pair of leads have arm portions that interleave arm portions of the other of the pair of leads, and wherein the leads are connected to a control circuit that outputs a control signal resistance that varies with the resistance of the force sensing device.

14. The musical effect system of claim 13, wherein one of the pair of leads have arm portions that interleave arm portions of the other of the pair of leads.

15. The musical effect system of claim 14, wherein the leads are connected to a control circuit that outputs a control signal voltage that varies with the resistance of the force sensing device.

16. The musical effect system of claim 13, wherein one of the pair of leads terminates in a first layer, the other one of the pair of leads terminates in a second layer, and the pressure sensitive material is formed as a third layer disposed between the first and second layer.

17. The musical effect system of claim 13, the electrical resistance between the pair of leads changes substantially linearly with changes in force applied to the force sensing device.

18. A musical effect system of comprising:

an electric guitar having strings and a pick-up that produces an electrical music signal from vibrations of the strings;

a musical effect generator that receives the electrical music signal from the guitar and alters the musical signal to produce a musical effect;

a guitar pick for striking the strings to cause the vibrations;

a force sensing device mounted on the guitar pick and having a pair of electrical leads connectable to the musical effect generator, the force sensing device includes a pressure sensitive material that is formed of one of a semiconductor material having microprotrusions and a pressure sensitive ink, wherein the electrical leads are in contact with the pressure sensitive material such that electrical resistance between the pair of leads incrementally and repeatably decreases as a force applied to the force sensing device incrementally increases; and a compressible layer of material overlaying the force sensing device to give tactile feedback to the musician;

wherein the musical effect generator is responsive to, and varies the musical effect according to, the resistance between the pair of leads.

19. A musical effect system, comprising:

an electric guitar having strings and a pick-up that produces an electrical music signal from vibrations of the strings;

a musical effect generator that receives the electrical music signal from the guitar and alters the musical signal to produce a musical effect;

a guitar pick for string the strings to cause the vibrations; and a force sensing device mounted on the guitar pick and having a pair of electrical leads connectable to the musical effect generator, the force sensing device includes a pressure sensitive material that is formed of one of a semiconductor material having microprotrusions and a pressure sensitive ink, wherein the electrical leads are in contact with the pressure sensitive material such that electrical resistance between the pair of leads incrementally and repeatably decreases as a force applied to the force sensing device incrementally increases;

wherein the musical effect generator is responsive to, and varies the musical effect according to, the resistance between the pair of leads, and wherein the guitar pickup and the pair of electrical leads are connected to the musical effect generator by a stereo cable.

20. A musical effect generator for an electric guitar having a first signal output cable and a ground cable, and for a musical effect sensor having a second signal output cable and a ground cable, wherein the first and second signal output cables and the ground cables are combined into a stereo cable terminating in a stereo plug, the musical effect generator comprising:

a housing;

an input stereo jack mounted at the housing for receiving the stereo plug;

a musical effect circuit located in the housing that receives an electrical music signal from the first signal output cable and a musical effect signal from the second signal output cable via the input stereo jack, the musical effect circuit alters the electrical music signal based upon the musical effect signal to produce a musical effect; and an output jack mounted at the housing for receiving the altered music signal from the musical effect circuit.

21. The musical effect generator of claim 20, wherein the musical effect circuit is responsive to, and varies the musical effect according to, the resistance between the second signal output cable and the ground cables.

22. The musical effect generator of claim 21, further comprising:

a control circuit that outputs a control signal voltage that varies with the resistance between the second signal output cable and the ground cables.

23. The musical effect generator of claim 21, further comprising:

a control circuit that outputs a control signal resistance that varies with the resistance between the second signal output cable and the ground cables.

24. The musical effect generator of claim 21, wherein the musical effect is a modification of a property of the electrical music signal that includes at least one of amplitude, frequency response, envelope characteristics, echo, reverberation and distortion.

* * * * *